United States Patent [19]

Küpper

[11] 4,103,836

[45] Aug. 1, 1978

[54] UNDOING OR REMOVING THE THREAD ENDS OF TEXTILE BOBBINS

[75] Inventor: Willi Küpper, Rickelrath, Germany

[73] Assignee: W. Schlafhorst & Co., Mönchen-Gladbach, Germany

[21] Appl. No.: 699,843

[22] Filed: Jun. 25, 1976

[30] Foreign Application Priority Data

Jun. 25, 1975 [DE] Fed. Rep. of Germany ..... 2528281

[51] Int. Cl.[2] ..... B65H 54/22; B65H 67/08

[52] U.S. Cl. ..... 242/35.6 E

[58] Field of Search ..... 242/35.6 E, 35.6 R, 242/35.5 R, 18 R, 18 EW

[56] References Cited

U.S. PATENT DOCUMENTS

| | | | |
|---|---|---|---|
| 3,059,866 | 10/1962 | Reiners | 242/35.6 E |
| 3,352,504 | 11/1967 | Furst | 242/35.6 E |
| 3,355,118 | 11/1967 | Küpper | 242/35.6 E |
| 3,388,872 | 6/1968 | Küpper | 242/35.6 E |
| 3,406,920 | 10/1968 | Kamp | 242/35.6 E |
| 3,441,230 | 4/1969 | Küpper | 242/35.6 E |
| 3,464,640 | 9/1969 | Küpper | 242/35.6 E |
| 3,608,843 | 9/1971 | Siedlich | 242/35.6 E |
| 4,009,840 | 3/1977 | Muller | 242/35.6 E |

FOREIGN PATENT DOCUMENTS

| | | | |
|---|---|---|---|
| 2,423,493 | 11/1975 | Fed. Rep. of Germany | 242/34.6 E |

*Primary Examiner*—Stanley N. Gilreath
*Attorney, Agent, or Firm*—Herbert L. Lerner

[57] ABSTRACT

Undoing or removing thread ends of individually transported textile bobbins which are rotated during the transport about their longitudinal axis and which are blasted with compressed air during the transport from at least one blasting nozzle is effected more efficiently by moving the blasting nozzle in the direction of the longitudinal axis of the textile bobbin or the travel direction of the textile bobbin, or both, to obtain controlled intensity and time, particularly to blast certain zones of the textile bobbin longer or more intensively than others.

8 Claims, 2 Drawing Figures

FIG.1
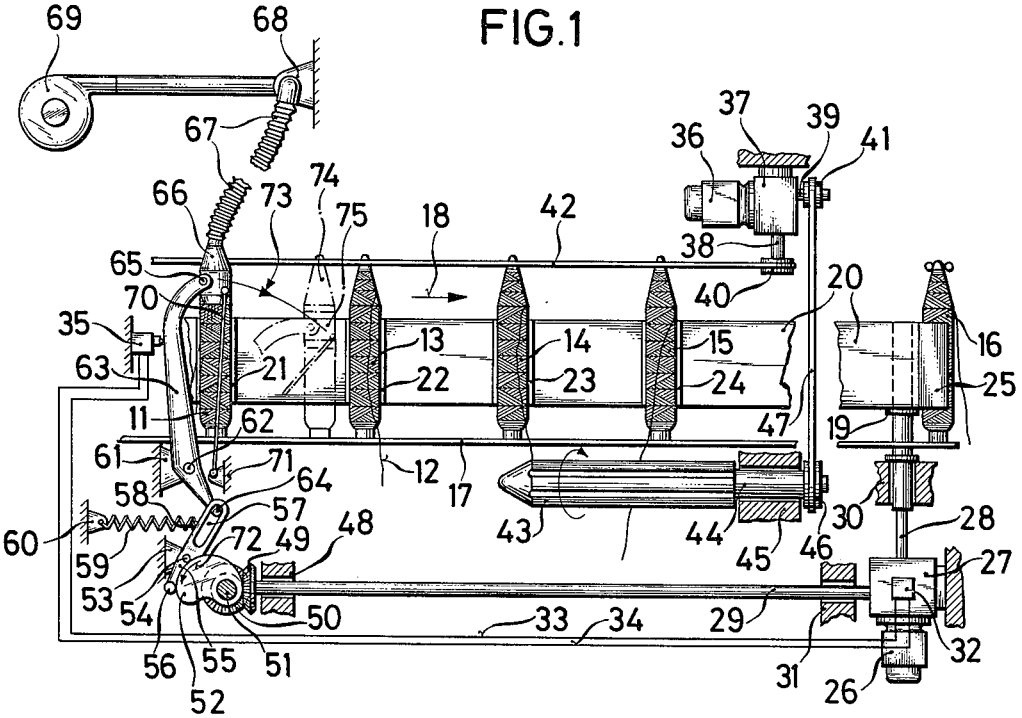
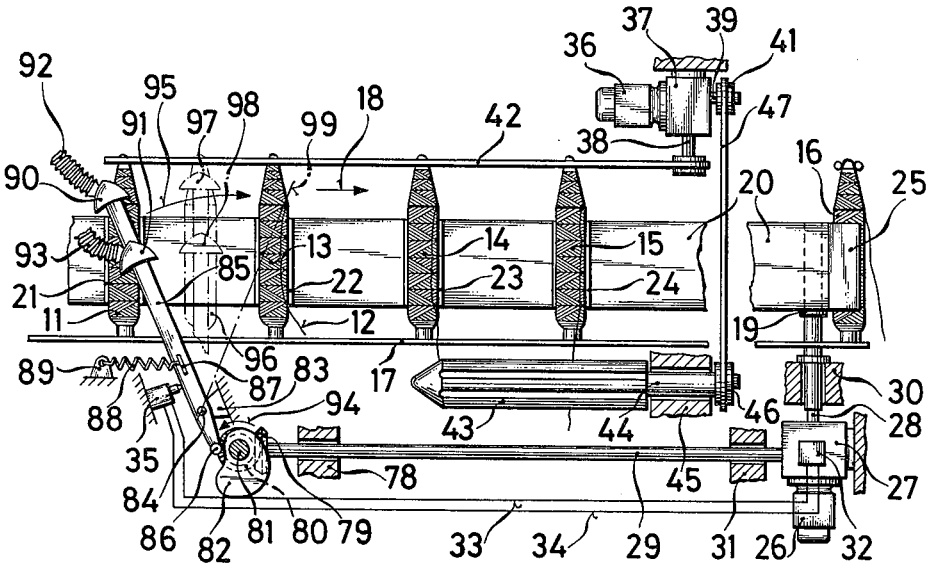
FIG.2

UNDOING OR REMOVING THE THREAD ENDS OF TEXTILE BOBBINS

This invention relates to undoing and/or removing the upper and/or lower turns and/or thread ends of individually transported textile bobbins which are rotated about their longitudinal axis during the transport and are blasted with compressed air from at least one blasting nozzle during the transport. Such devices serve to lay out or shorten the thread ends and ready them for a further processing operation.

Mechanical and pneumatic devices for undoing and/or removing the upper or lower turns of textile bobbins and for undoing and/or removing the thread ends, hereinafter collectively referred to as undoing or removing thread ends, are known. Mechanical devices for this purpose have not been entirely satisfactory because of the danger of damaging the winding.

In the case of pneumatic devices, stationary blasting nozzles are used, and the textile bobbin is transported past such stationary blasting nozzles. The textile bobbins are rotated about their longitudinal axis in the process. In this regard, it is a disadvantage that the textile bobbins cannot be blasted with the same intensity either over the entire length nor over the entire circumference. Attempts have been made to obtain more intensive blasting by means of slit-like blasting nozzles which are elongated in the transport direction of the textile bobbins. This procedure has the disadvantage of requiring a disproportionally large amount of compressed air, and even under these conditions the desired blasting intensity is still not obtained. It has also been proposed to increase the number of blasting nozzles. But, here too, the power requirement and the amount of technical equipment are increased materially, resulting in substantially higher capital investment and operating costs.

It is accordingly an object of the invention to provide means for blowing air against the entire cylinder surface of the textile bobbins and while doing so, to increase the intensity of the blast or to concentrate it on selected zones of the bobbin surface as required.

With the foregoing and other objects in view, there is provided in accordance with the invention apparatus for undoing or removing thread ends of individually transported textile bobbins which are rotated during the transport about their longitudinal axis and which are blasted with compressed air during the transport from at least one blasting nozzle, and which includes nozzle control means for moving the blasting nozzle in the direction of the longitudinal axis of the textile bobbins to obtain controlled intensity of the air blast on the surface of the textile bobbin for a controlled period of time.

In a preferred embodiment there are included nozzle transport means for moving the blasting nozzle in the travel direction of the textile bobbin simultaneously with the textile bobbin.

Other features which are considered as characteristic for the invention are set forth in the appended claims.

Although the invention is illustrated and described herein as embodied in undoing or removing the thread ends of textile bobbins, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawing, in which:

FIG. 1 diagrammatically illustrates apparatus in side view for undoing the thread end of a textile bobbin in accordance with the invention; and FIG. 2 diagrammatically illustrates another form of apparatus for undoing the thread end of a textile bobbin.

In accordance with the invention, the blasting nozzle can be controlled to be moved in the direction of the longitudinal axis of the textile bobbins and/or in their travel direction. Advantageously the blasting nozzle is movable in the travel direction simultaneously with the textile bobbin. Thus, the blasting nozzle follows the textile bobbin. During this procedure, the textile bobbin rotates about its own axis, thus enabling the entire circumference of the bobbin to be blasted uniformly. Simultaneous with movement of the blasting nozzle in the travel direction of the textile bobbin, the blasting nozzle can have a relative motion which is in the direction of the bobbin axis.

The blasting time can be controlled in such manner that certain zones of the textile bobbin are blasted longer or more intensively than others, or both. In practice, the blasting time can be controlled by carrying out the relative motion of the blasting nozzle in the direction of the longitudinal axis of the bobbin, more slowly or faster. The same effect can be obtained also by making the relative motion of the blasting nozzle in the travel direction of the textile bobbins nonuniform. In this regard, a more intensive blasting of a given bobbin zone can be achieved by providing that the blasting nozzle first lead the textile bobbin somewhat and then retarding its motion, or alternatively causing it to remain in its position for a short time.

The advantages obtained with the invention are, in particular, that the entire outside surface of the bobbin can be blasted with little power required and the blasting time and the intensity of the blasting can be concentrated on certain regions or zones of the textile bobbin.

Two examples of embodiments of the invention are shown in FIGS. 1 and 2 of the drawing and shown apparatus for undoing the thread end of a textile bobbin 11. Referring to the drawing, the textile bobbin 11 is in the present case a spinning cop, which together with several similar textile bobbins 13 to 16 is transported on a plane grate 17 in the direction of the arrow 18. The transport of the bobbins is provided by a conveyer belt 20 driven by a belt roll 19. The conveyor belt 20 has carrier pockets 21 to 25, in which the textile bobbins are deposited.

A drive motor 26 is connected to a gear box 27, with the output or drive shafts 28 and 29 supported in shaft bearings 30 and 31. The gear box 27 has a gear switch 32, which can be operated via electrical lines 33, 34 by an end switch 35. The drive shaft 28 leads to the belt roll 19. A further drive motor 36 is connected to a gear box 37 which has two output shafts 38, 39. The drive shaft 38 carries a pulley 40 and the drive shaft 39, a pulley 41. The pulley 40 drives an endless belt 42 which touches the tips of the bobbin tubes of the textile bobbins 11, 13, 14 and 15 and thereby sets the bobbins in rotation about their longitudinal axes.

Below the plane grate 17, a thread pull-off drum 43 is arranged. It has a shaft 44 which is supported in stationary relationship in a sleeve bearing 45. A pulley 46 is attached to the end of the shaft 44 and pulley 46 is driven via a belt 47 from the pulley 41 of the gear box 37.

Thus far, there is no difference between the embodiment examples as shown in FIG. 1 and FIG. 2. In the example according to FIG. 1, the output shaft 29 has a second stationary sleeve bearing 48.

A miter gear 49 mounted at the end of the shaft 29 meshes with a miter gear 50. The shaft 51 of the miter gear 50 carries an eccentric 52. The bearing pin 54 of a two-armed lever 55 is fulcrumed in a stationary pillow block 53. At the lower end of the lever, a feeler roll 56 is attached which makes contact with the contour of the cam 52. The other end of the lever has a guide slot 57 and a spring eye 58, into which a tension spring 59 is hooked, the other end of which is fastened in a stationary spring eye 60.

Another stationary pillow block 61 supports the bearing pin 62 of a two-armed lever 63. A roller 64, which protrudes or extends into the guide slot 57 of the lever 55, is attached at the lower end of the lever 63. A blasting nozzle 66 at the upper end of the lever 63 is fastened at a joint 65. The blasting nozzle 66 is supplied with compressed air by a blower 69 via a flexible line or hose 67, which ends at a bracket 68. The mouth of the blasting nozzle 66 has the shape of a slit and is located in front of the textile bobbin 11 as seen in the line of vision of the observer. The escaping compressed air is indicated by a succession of short lines. For purposes of parallel guidance, there is attached to the blasting nozzle 66, in a flexible manner, a guide rod 70, the other end of which is pivotally attached to a stationary bracket 71. As soon as the shaft 51 rotates in the direction of the arrow 72, the distance of the feeler roll 56 from the shaft 51 is reduced, so that the tension spring 59 can release its tension. The tension spring 59 pulls the upper end of the lever 55 to the left, while the roller 64 of the lever 63 is likewise moved to the left. The longer arm of the lever 63 then travels to the right, causing the blasting nozzle 66 to swing in a circular arc in the direction of the arrow 73 from top left to bottom right.

As will be seen from FIG. 1, the blasting nozzle 66 is located exactly in front of the textile bobbin 11 in its uppermost position. Because the belt roll 19 and the shaft 51 are driven together by the same gear box, the further motion of the blasting nozzle 66 proceeds so that it follows the travelling bobbin 11 and is always located in front of the bobbin. In the process, the blasting nozzle 66 executes at the same time a relative motion in the direction of the longitudinal axis of the bobbin 11 from top to bottom. If in the course of its further travel, the textile bobbin is situated, for example, in the position 74, then the blasting nozzle has correspondingly reached at the same time the position 75. Because of the special shape of the cam 52, the blasting nozzle 66 is returned very rapidly to the starting position shown in FIG. 1. In the starting position, the blasting nozzle again stands in front of the next textile bobbin.

The rotary motion of the textile bobbins about their longitudinal axes is against the winding direction of the textile thread. When the textile bobbin is blasted, the last turns of the bobbin are therefore loosened and it is thereby made easier to find, undo and grip the thread end.

In the case of the textile bobbin 13, it will be noted that the thread end 12 is already separated and has been blown downward between the rods of the plane grate 17. During further travel of the textile bobbin 13, its thread end is engaged by the thread pull-off cylinder 43 and is pulled off further, while an air suction system, not shown, can receive the thread end until a thread clipper, not shown, finally severs the thread. The textile bobbin 16, for example, has already passed the thread clipper. The thread end of this bobbin extends only to the base of the bobbin tube, as can be seen in the drawing.

As a result of the movement of the blasting nozzle 66 in synchronism with the movement of the textile bobbin and the simultaneous rotation of the bobbin about its longitudinal axis; the entire cylinder surface of the bobbin is exposed to the concentrated stream of blast air, the end of the textile thread is seized with a high degree of certainty, is separated from the bobbin surface and blown between the rods of the plane grate 17.

In the embodiment example of the invention according to FIG. 2, the drive shaft 29 has a second sleeve bearing 78. The end of the shaft carries a miter gear 79, which meshes with a miter gear 80. A cam 82 is mounted on the shaft 81 of the miter gear 80. The fulcrum pin 84 of a two-armed lever 85 is pivoted at a stationary pillow block 83. At the lower end of the lever, a feeler roller 86 is fastened which follows the contour of the cam 82. The other end of the lever has a spring eye 87, into which a tension spring 88 is hooked, the other end of which is fastened at a stationary bracket 89.

Two blasting nozzles 90, 91 are fastened at the longer arm of the lever 85 on top of each other, that is, one above the other. The blasting nozzles 90 and 91 are connected, via flexible lines 92, 93, to a blower, not shown, which supplies the blasting nozzles with compressed air. The outlets of the blasting nozzles have the form of slits and are located in front of the textile bobbin 11.

As soon as the shaft 81 rotates in the direction of the arrow 94, the distance of the feeler roller 86 from the shaft 81 increases, so that the shorter end of the lever 85 is swung to the left and the longer end to the right in the direction of the arrow 95.

As may be seen from FIG. 2, the blasting nozzle 90 is at an angle in front of the upper part and the blasting nozzle at an angle in front of the center part of the textile bobbin 11. The blasting air is directed at an angle downward against the surface of the textile bobbin 11.

Because the belt roll 19 and the shaft 81 are driven together by the same gear box 27, the further movement of the blasting nozzles 90, 91 is carried out so that the nozzle outlets follow the traveling bobbin 11. The blasting nozzles 90 and 91 at the same time have a relative motion in the direction of the longitudinal axis of the bobbin 11. The direction of this relative motion is at first from the bottom up, and then reverses. If, for example, the textile bobbin 11 in its further travel is in the position 96, then the blasting nozzle 90 has reached the position 97 and the blasting nozzle 91 the position 98. In this example, the two-armed lever 85 can move up to the center line 99.

Because of the special shape of the cam 82, the blasting nozzles 90 and 91 are very quickly returned to the starting position shown in FIG. 2. In the starting position, the blasting nozzles 90 and 91 are then positioned obliquely in front of the next textile bobbin. Here, too, the rotary motion of the textile bobbins is against the winding direction of the textile thread. In the case of the textile bobbin 13, the thread end 12 is already separated and here also has been blown downward between the rods of the plane grate 17. During the further travel of the textile bobbin 13, its thread end is seized by the thread pulling-off cylinder 43 and is pulled off further as is illustrated by the thread end of the textile bobbin 15.

The end switches 35, shown in FIGS. 1 and 2, serve to switch off the gear box 27 of the drive motor 26 for a brief time, if desired, when the starting position of the blasting nozzles is reached. The brief stopping of the conveyer belt 20 may be necessary for the proper functioning of the transporting system, for passing-on or accepting textile bobbins by the transporting system or for other purposes. It was found advantageous to stop the bobbins in the normal position of the blasting nozzles, i.e., at the beginning of the blasting operation of the respective bobbin. In most cases, separation or at least loosening of the thread end takes place then.

These are claimed:

1. In apparatus for undoing or removing thread ends of individually transported textile bobbins which are rotated about their longitudinal axis during transport thereof in a given direction generally transverse to the longitudinal axis of the bobbins and which are blasted with compressed air during the transport from at least one blasting nozzle, the improvement comprising nozzle control means for moving the blasting nozzle axially of the textile bobbins to obtain controlled intensity of the air blast on the surface of the textile bobbin for a controlled period of time.

2. Apparatus according to claim 1, including nozzle transport means for moving the blasting nozzle in the given transport direction of the textile bobbin simultaneously with the textile bobbin.

3. In apparatus for undoing or removing thread ends of individually transported textile bobbins which are rotated about their longitudinal axis during transport thereof in a given direction and which are blasted with compressed air during the transport from at least one blasting nozzle, the improvement comprising nozzle control means for moving the blasting nozzle in the direction of the longitudinal axis of the textile bobbins to obtain controlled intensity of the air blast on the surface of the textile bobbin for a controlled period of time, nozzle transport means for moving the blasting nozzle in the given transport direction of the textile bobbin simultaneously with the textile bobbin, said means for moving the blasting nozzle in the direction of the longitudinal axis of the textile bobbin and the given transport direction of the textile bobbin comprising a first two-armed lever fulcrumed in a stationary block and movably carrying said blasting nozzle at one end thereof, a second two-armed lever fulcrumed in another stationary block, a roller connected to the other end of the first two-armed lever and protruding into and movable in a guide slot formed in an upper end of said second two-armed lever, a feeler roller attached to a lower end of the second two-armed lever, and a rotating cam having its contour in contact with said feeler roller.

4. In apparatus for undoing or removing thread ends of individually transported textile bobbins which are rotated about their longitudinal axis during transport thereof in a given direction and which are blasted with compressed air during the transport from at least one blasting nozzle, the improvement comprising nozzle control means for moving the blasting nozzle in the direction of the longitudinal axis of the textile bobbins to obtain controlled intensity of the air blast on the surface of the textile bobbin for a controlled period of time, nozzle transport means for moving the blasting nozzle in the given transport direction of the textile bobbin simultaneously with the textile bobbin, said means for moving the blasting nozzle in the direction of the longitudinal axis of the textile bobbin and in the given transport direction of the textile bobbin comprising a two-armed lever having a longer and a shorter arm, two blasting nozzles fastened one above another at the top of the longer arm of the two-armed lever, said two-armed lever being pivotally mounted near its lower end at a stationary block, a feeler roller attached to the lower end of the two-armed lever, and a rotating cam in contact with the feeler roller and causing the two-armed lever to pivotally move.

5. In a method of undoing or removing thread ends of individually transported textile bobbins that are rotated about the longitudinal axis thereof during transport thereof in a direction transverse to the longitudinal axis thereof and that are blasted with compressed air from at least one blasting nozzle during the transport, the improvement which comprises moving the blasting nozzle along the respective transported textile bobbins axially of the textile bobbins to obtain controlled intensity of the air blast on the surface of the textile bobbin for a controlled period of time.

6. Method according to claim 5 which includes moving the blasting nozzle simultaneously with the textile bobbin in the transport direction of the textile bobbin transversely to the longitudinal axis thereof.

7. Method according to claim 6 which includes moving the blasting nozzle and the textile bobbin relatively to one another axially of the textile bobbin so as to shorten and increase the blasting time selectively.

8. Method according to claim 5 which includes moving the blasting nozzle and the textile bobbin relative to one another in the given transport direction of the textile bobbin so as to shorten and increase the blasting time selectively.

* * * * *